US009156136B2

(12) United States Patent
Zhan et al.

(10) Patent No.: US 9,156,136 B2
(45) Date of Patent: Oct. 13, 2015

(54) SYSTEMS AND METHODS FOR VAPOR PRESSURE LEACHING POLYCRYSTALLINE DIAMOND CUTTER ELEMENTS

(71) Applicant: National Oilwell Varco, L.P., Houston, TX (US)

(72) Inventors: Guodong Zhan, Spring, TX (US); Walter R. Rothrock, New Caney, TX (US); Parul Walia Dhall, Spring, TX (US); Michael S. Nixon, Pearland, TX (US); Terry R. Matthias, Gloucester (GB)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 10 days.

(21) Appl. No.: 14/073,243

(22) Filed: Nov. 6, 2013

(65) Prior Publication Data

US 2014/0123565 A1 May 8, 2014

Related U.S. Application Data

(60) Provisional application No. 61/723,529, filed on Nov. 7, 2012.

(51) Int. Cl.

| | |
|---|---|
| ***B24D 18/00*** | (2006.01) |
| ***B24D 3/10*** | (2006.01) |
| ***C23F 1/08*** | (2006.01) |
| ***C23F 1/12*** | (2006.01) |
| *C22B 3/02* | (2006.01) |
| *C22C 26/00* | (2006.01) |

(52) U.S. Cl.

CPC *B24D 18/00* (2013.01); *B24D 3/10* (2013.01); *C23F 1/08* (2013.01); *C23F 1/12* (2013.01); *C22C 26/00* (2013.01); *C22C 2204/00* (2013.01)

(58) Field of Classification Search

CPC ..... C22B 3/02

See application file for complete search history.

(56) References Cited

U.S. PATENT DOCUMENTS 3,825,419 A 7/1974 Chen
4,008,076 A 2/1977 Junghanss et al.

(Continued)

FOREIGN PATENT DOCUMENTS

WO 2007/042920 A1 4/2007

OTHER PUBLICATIONS

Yagishita, Teruo, et al., "Cleaning of Copper Surface Using Vapor-Phase Organic Acids," Association of Super-Advanced Electronics Technologies (ASET), Japan, Proceedings of the Symposium on Semiconductors and Integrated Circuits Technology, vol. 65, pp. 54-57 (2003) (1 page).

(Continued)

*Primary Examiner* — Pegah Parvini
*Assistant Examiner* — Alexandra M Moore
(74) *Attorney, Agent, or Firm* — Conley Rose, P.C.

(57) ABSTRACT

A method is disclosed for leaching a polycrystalline diamond (PCD) cutter element. In an embodiment, the method includes suspending the PCD cutter element above a liquid acid bath. In addition, the method includes elevating the temperature of the liquid acid bath above ambient conditions to transition at least some of the liquid acid bath to acid vapors. Further, the method includes elevating the pressure of the acid vapors above ambient conditions. Still further, the method includes exposing the PCD cutter element to the acid vapors.

11 Claims, 6 Drawing Sheets

(56) References Cited

U.S. PATENT DOCUMENTS

| | | | | |
|---|---|---|---|---|
| 4,011,091 | A * | 3/1977 | McCollister | 501/4 |
| 6,379,637 | B1 | 4/2002 | Curlook | |
| 7,712,553 | B2 | 5/2010 | Shamburger | |
| 7,972,395 | B1 | 7/2011 | Dadson | |
| 8,002,859 | B2 | 8/2011 | Griffo et al. | |
| 2007/0169419 | A1 * | 7/2007 | Davis et al. | 51/293 |
| 2008/0286182 | A1 | 11/2008 | Costa et al. | |
| 2010/0095602 | A1 | 4/2010 | Belnap et al. | |
| 2011/0048172 | A1 | 3/2011 | Schlienger et al. | |
| 2011/0212303 | A1 | 9/2011 | Fuller et al. | |
| 2012/0151847 | A1 | 6/2012 | Ladi et al. | |

OTHER PUBLICATIONS

PCT/US2013/068690 International Search Report and Written Opinion dated Feb. 11, 2014 (9 p.).

* cited by examiner

SYSTEMS AND METHODS FOR VAPOR PRESSURE LEACHING POLYCRYSTALLINE DIAMOND CUTTER ELEMENTS

CROSS-REFERENCE TO RELATED APPLICATIONS

This application claims benefit of U.S. provisional patent application Ser. No. 61/723,529 filed Nov. 7, 2012, and entitled "Methods for Vapor Pressure Leaching Polycrystalline Diamond Cutter Elements," which is hereby incorporated herein by reference in its entirety.

STATEMENT REGARDING FEDERALLY SPONSORED RESEARCH OR DEVELOPMENT

Not applicable.

BACKGROUND

The invention relates generally to rotary drill bits. More particularly, the invention relates to systems and methods for leaching Polycrystalline Diamond ("PCD") cutter elements.

Oil and gas drilling operations often employ fixed cutter drill bits to drill through various rock formations in an effort to access hydrocarbon reserves below the ground. Fixed cutter drill bits employ a plurality of cutter elements that engage, scrape, and shear the earthen formation being drilled through. Such cutter elements are typically made of a layer or table of Polycrystalline Diamond ("PCD") bonded to a cobalt cemented, tungsten carbide (WC) substrate.

To manufacture PCD tables for cutter elements and bond the tables to the substrate, diamond powder is placed at the bottom of a first mold or can along with a catalyst. The substrate is then placed on top of the diamond powder within the first mold, a second mold or can is placed on top of the substrate, and a seal is formed between the first and second cans. This entire assembly is then subjected to high pressure and temperature conditions to form a PCD cutter element. In general, any Group VIII element (e.g., cobalt, nickel, or iron) can be used as the catalyst, however, in most cases, cobalt (Co) is employed. The catalyst is driven into the interstitial spaces between the diamond grains and promotes intergrowth therein, to form a solid PCD diamond table suitable for use in a cutter element. The high pressure and temperature conditions also facilitate bonding between the newly formed PCD table and the substrate, thereby resulting in a fully formed PCD cutter element.

During drilling operations, cutter elements experience relatively high temperatures due, at least in part, to the general nature of the downhole environment and friction between the cutter elements and the formation. The thermal loads result in expansion of the material components of the cutter elements. Due to differences in the coefficients of thermal expansion between the catalyst and the diamond grains, at sufficiently high temperatures, undesirable cracks can form in the PCD lattice structure. These cracks can lead to failure of the corresponding cutter element(s), reduced cutting efficiency, and reduced cutting effectiveness. In addition, high thermal loads can lead to the undesirable formation of compounds such as, for example, carbon monoxide, carbon dioxide, or graphite within the PCD table itself. The presence of such compounds in the PCD table can further reducing the cutting effectiveness and strength of the corresponding PCD cutter element. Accordingly, it is generally desirable to remove at least a portion of the catalyst from the PCD table after its formation to enhance cutter element durability over a broader range of operating temperatures.

A common approach for removing the catalyst from a PCD table is to leach the PCD table to remove some or substantially all of the interstitial catalyst from the PCD lattice structure, thereby transforming the PCD material into thermally stable polycrystalline diamond. Leaching typically involves placing the cutter element in a strong acid bath at an elevated temperature to expose the PCD table to the acid. Suitable acids for leaching include nitric acid, sulfuric acid, hydrofluoric acid, hydrochloric acid, and combinations thereof. Although such leaching acids can aid in removing the catalyst from the PCD table, they can also damage the underlying substrate to which the PCD table is secured.

Conventional leaching via acid bath is a relatively time-consuming as it may take days or even weeks to remove a sufficient quantity of the binding agent from the PCD table. This increases the overall time, and associated costs, to manufacture cutter elements and fixed cutter drill bits.

BRIEF SUMMARY OF THE DISCLOSURE

Some embodiments are directed to a system for leaching a polycrystalline diamond (PCD) cutter element having a PCD table and a substrate. In an embodiment, the system includes a housing having an open first end and a closed second end. In addition, the system includes a lid removably and sealingly attached the first end of the housing. The housing and the lid define an inner chamber extending between the first end and the second end, and the inner chamber is configured to receive and hold a volume of liquid acid therein. Further, the system includes a cutter element holder disposed within the inner chamber, wherein the PCD cutter element is suspended above the volume of liquid acid in the inner chamber with the holder.

Other embodiments are directed to a method for leaching a polycrystalline diamond (PCD) cutter element. In an embodiment, the method includes suspending the PCD cutter element above a liquid acid bath and elevating the temperature of the liquid acid bath above ambient conditions to transition at least some of the liquid acid bath to acid vapors. In addition, the method includes elevating the pressure of the acid vapors above ambient conditions. Further, the method includes exposing the PCD cutter element to the acid vapors.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the disclosed embodiments, reference will now be made to the accompanying drawings in which.

DETAILED DESCRIPTION OF THE PREFERRED EMBODIMENTS

Figure 1:
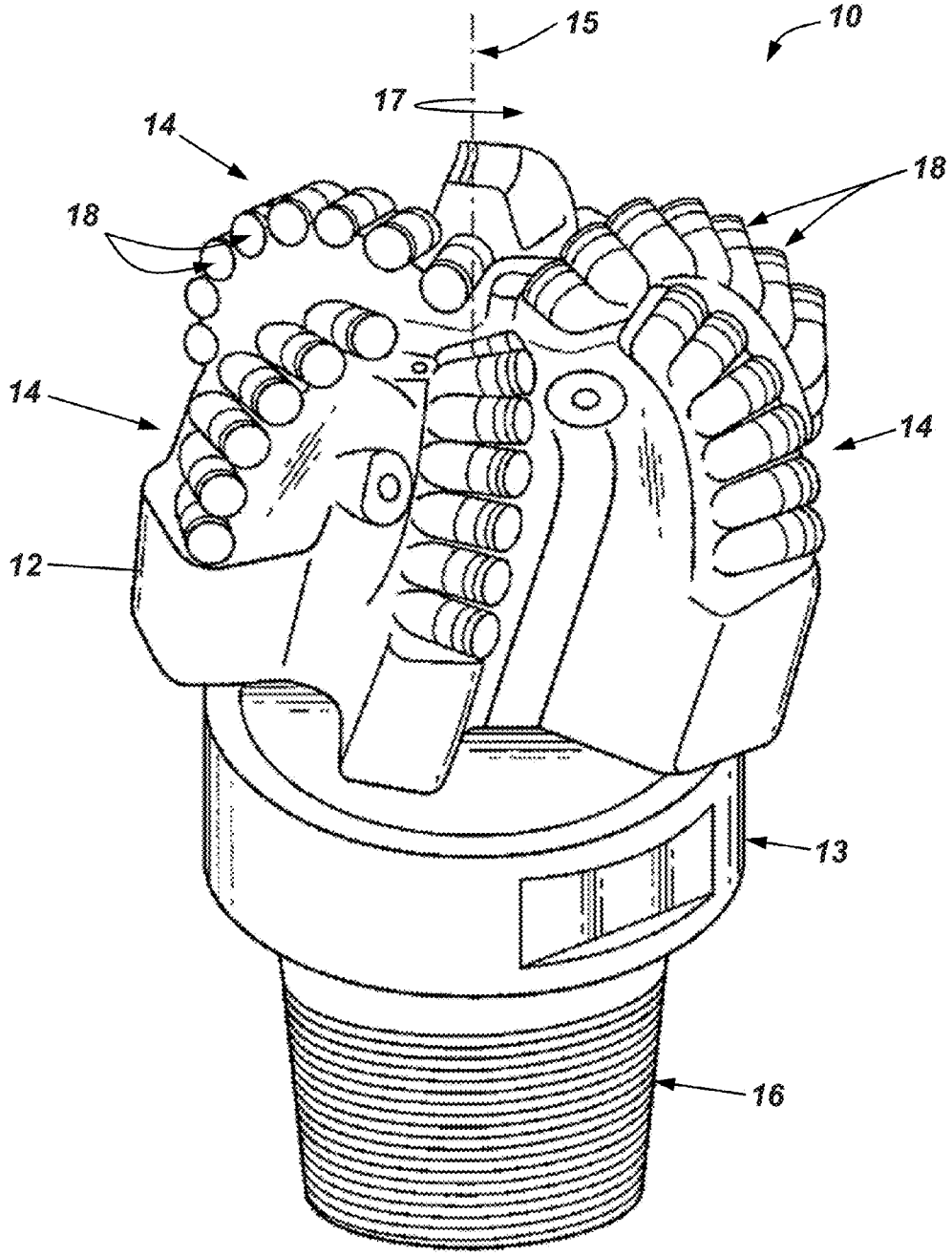
FIG. 1 is perspective view of an embodiment of a fixed cutter drill bit employing PCD cutter elements manufactured in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. As used herein, the term "depth of leaching" refers to the distance into the PCD cutter element, from the outer surface thereof, which the leaching acid has penetrated to during the leaching process to thereby remove catalyst therefrom.

Referring now to FIG. 1, an embodiment of a fixed cutter drill bit 10 is shown. Drill bit 10 has a bit body 12, a shank 13, a threaded pin end 16, and a central longitudinal axis 15 about which bit 10 is rotated in a cutting direction 17 during drilling operations. Bit 10 also includes a plurality of blades 14 running along the outside of body 12, each blade 14 generally extends radially outward relative to axis 15. A plurality of cutter elements 18 manufactured in accordance with the principles described herein are mounted side-by-side along each blade 14. In addition, each cutter element 18 is positioned and oriented to face the same general direction—the leading face of each cutter element 18 (relative to cutting direction 17) is oriented perpendicular to cutting direction 17.

During drilling operations, bit 10 is disposed at the lower end of a drill string (not shown) via threaded pin end 16, and weight-on-bit ("WOB") is applied to force bit 10 against the formation while bit 10 is rotated about axis 15 in the cutting direction 17 as cutter elements 18 engage the formation and scrape and shear portions thereof. As chips of the formation are broken off and transported to the surface with drilling mud, bit 10 advanced through the formation along a predetermined trajectory.

Figure 2:
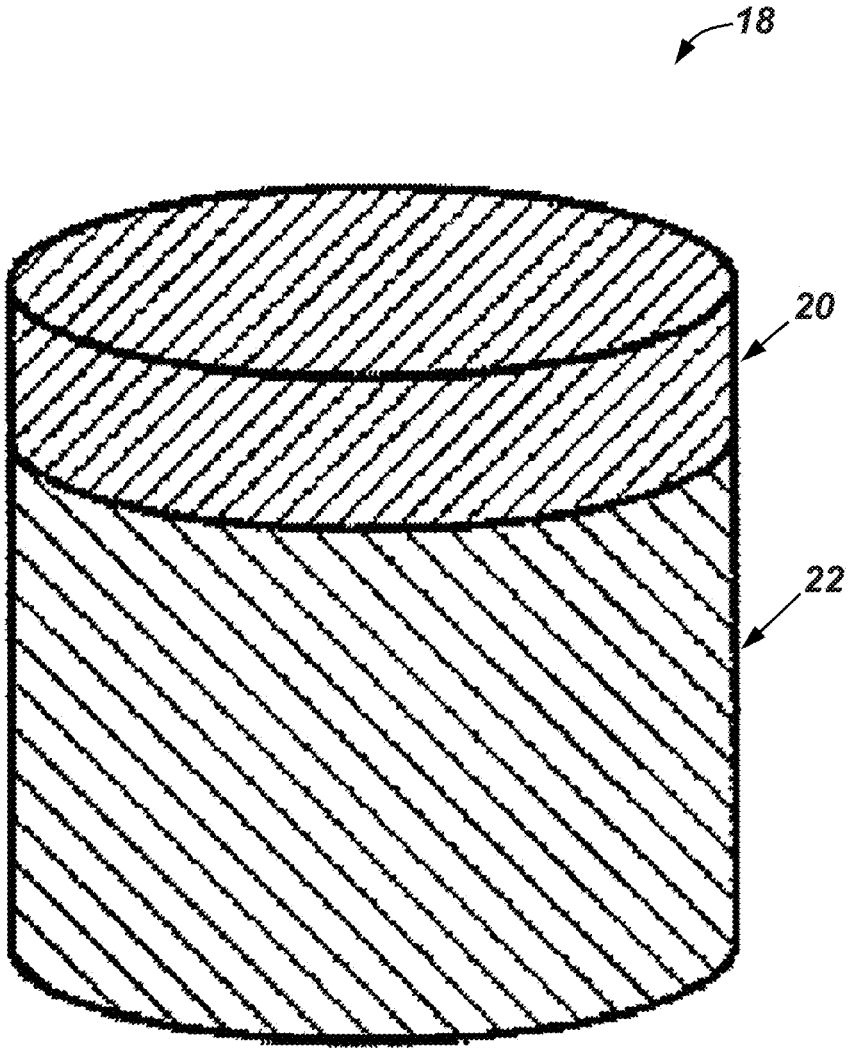
FIG. 2 is a perspective view of one PCD cutter element of the drill bit of FIG. 1.

Referring now to FIG. 2, one cutter element 18 of bit 10 is shown, it being understood that each cutter element 18 of bit 10 is the same. In this embodiment, each cutter element 18 includes a polycrystalline diamond ("PCD") layer or table 20 mounted to a tungsten carbide (WC) support member or substrate 22. As will be described in more detail below, PCT table 20 and substrate 22 are joined via a conventional "sintering" process. Namely, substrate 22 is placed on top of diamond grains and a catalyst such as Co or other Group VIII element within a mold, also referred to as a can. The diamond grains, catalyst, and substrate 22 are then subjected to high pressure and high temperature conditions to simultaneously form the solid PCD table 20 and bond the PCD table 20 to substrate 22. During the above described process, the diamond grains form a matrix of diamond crystals with catalyst disposed at several of the interstices.

As previously described, all or some of the catalyst is preferably removed from the PCD table 20 through a leaching process. Conventionally, leaching is performed by placing the cutter element (e.g., cutter element 18) in a liquid bath of leaching acid (e.g., nitric acid, sulfuric acid, hydrofluoric acid, hydrochloric acid, or some combination thereof) for an extended period of time. However, as previously described, such conventional leaching processes typically require long periods of time (e.g., weeks) to sufficiently reduce the amount of catalyst present in the lattice structure of the PCD table (e.g., PCD table 20), and further, in some cases can inadvertently damage the underlying WC substrate (e.g., substrate 22). Accordingly, in embodiments described herein, systems and methods for vapor leaching PCD cutter elements (e.g., cutter elements 18) that offer the potential to (a) reduce the total amount of time necessary to remove a sufficient amount of catalyst from the lattice structure of the PCD table, and/or (b) reduce inadvertent damage to the substrate as compared to conventional acid bath leaching techniques are disclosed.

Figure 3:
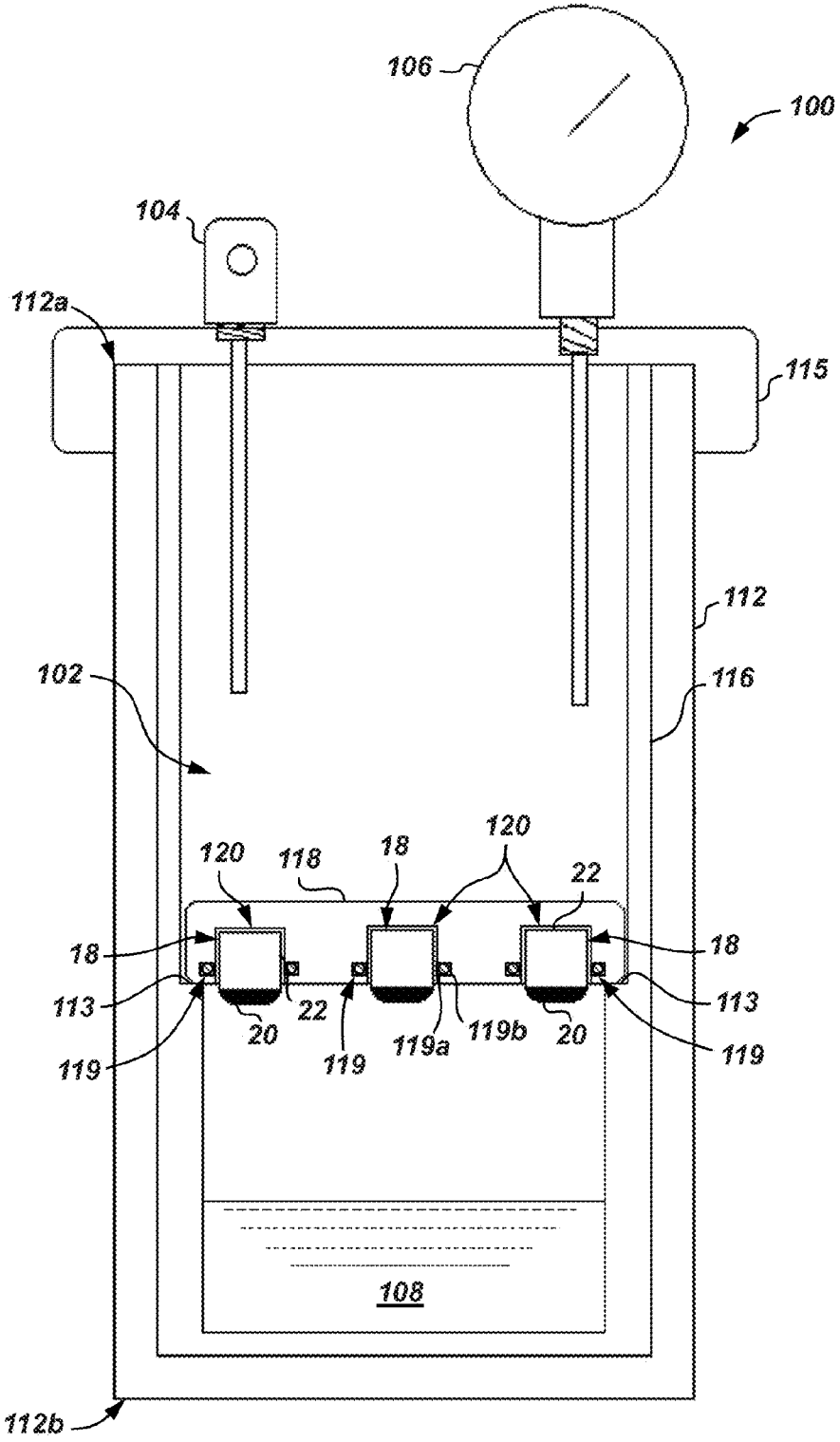
FIG. 3 is a schematic partial cross-sectional view of an embodiment of a system for vapor leaching PCD cutter elements in accordance with the principles disclosed herein.

Referring now to FIG. 3, an embodiment of a system 100 for vapor leaching one or more cutter elements 18 is shown. In this embodiment, system 100 100 is a pressure vessel including an outer housing or can 112, a lid 115 removably attached to can 112, a pressure gauge 106, and a relief valve 104. Can 112 has a first or upper open end 112*a* and a second or lower closed end 112*b*. Lid 115 is removably attached to upper end 112*a* to close can 112. With lid 115 secured to end 112*a*, lid 115 and can 112 define a sealed, fluid tight inner chamber 102. Pressure gauge 106 extends through lid 115 into chamber 102 and measures the pressure within chamber 102 during leaching operations. Relief valve 104 also extends through lid 115 and, as necessary, relieves excessive pressure within chamber 102. In particular, relief valve 104 has a closed position preventing fluid communication between chamber 102 and the environment surrounding can 112, and an open position allowing fluid communication between chamber 102 and the environment surrounding can 112. Thus, when relief valve 104 is closed, a pressure differential between chamber 102 and the environment surrounding can 112 can be induced, however, when relief valve 104 is open, the pressure inside chamber 102 is balanced with the pressure in the environment surrounding can 112 (i.e., there is no pressure differential between chamber 102 and the environment outside can 112). Relief valve 104 is normally closed, but is configured to transition to the open position at a predetermined pressure differential between chamber 102 and the environment outside can 112 to prevent inadvertent over-pressurization of can 112 and lid 115.

In this embodiment, the inner surface of can 112 includes an annular upward-facing shoulder 113 positioned between ends 112*a*, 112*b*. Shoulder 113 supports a cutter element holder or support 118 within chamber 102 between lower end 112*b* and lid 115.

In general, can 112 and lid 115 can be made out of any suitable material capable of withstanding relatively high temperatures and pressures within chamber 102 during the leaching process described in more detail below. Examples of suitable materials for can 112 and lid 115 include, without limitation, stainless steel, Inconel®, titanium, a composite (e.g., carbon fiber and epoxy composite), or some combination thereof. In this embodiment, can 112 and lid 115 are both made out of 316L stainless steel. In this embodiment an acid resistant lining 116 is adhered or bonded to the inner surface of can 112 to protect can 112 from the leaching acids disposed within chamber 102. In general, lining 116 can be made of any material suitable for use with leaching acids over extended periods of time at relatively high temperatures and pressures experienced during the leaching process described in more detail below. Examples of suitable materials for liner 116 include, without limitation, fluorinated alkylenes and perfluorocarbons. In this embodiment, lining 116 is made of polytetrafluoroethylene (i.e., TEFLON®). Since lining 116 defines the inner surface of can 112 in this embodiment, shoulder 113 is provided along lining 116.

Referring still to FIG. 3, cutter element holder 118 is an annular, cylindrical member including a plurality of receptacles or recesses 120 for releasably retaining and holding cutter elements 18 during leaching of PCD table 20. In particular, cutter elements 18 are seated in receptacles 120 with PCD tables 20 extending downward therefrom. In other words, receptacles 120 are sized and configured to completely surround substrates 22, while exposing PCD tables 20.

Figure 4:
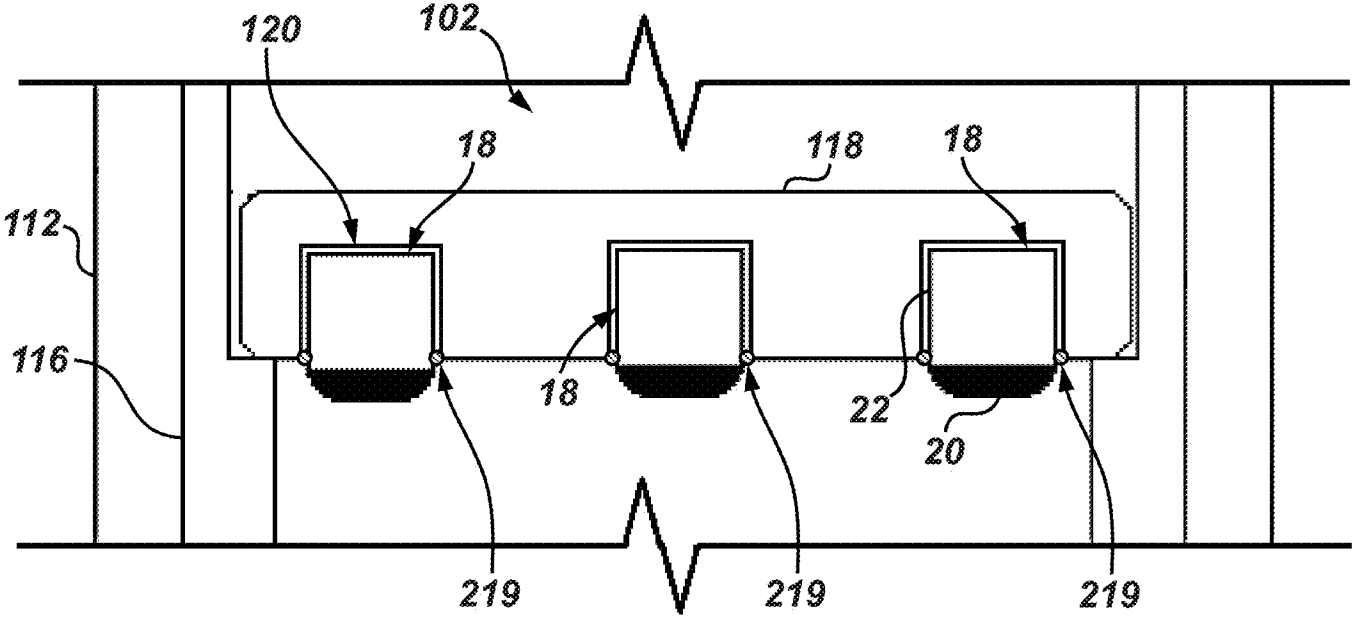
FIG. 4 is an enlarged cross-sectional view an embodiment of a support ring that can be used in the pressure can assembly of FIG. 3.

A sealing assembly 119 is provided within each receptacle 120 for forming an annular seal between ring 118 and each cutter element 18 retained therein. Each sealing assembly 119 sealingly engages the substrate 22 of the cutter element 18 disposed in the corresponding receptacle 118 from the environment within inner chamber 102, thereby protecting substrates 22 from the leaching acids within chamber 102. In general, any suitable sealing assembly or assemblies known in the art for restricting and/or preventing acids from access to substrates 22 can be employed while still complying with the principles disclosed herein. In this embodiment, each sealing assembly 119 comprises an O-ring 119*a* disposed in a mating annular seal gland 119*b* disposed along the cylindrical surface defining each recess 120. Each O-ring 119*a* forms an annular seal with ring 118 along its radially outer surface and forms an annular seal with the corresponding cutter element 18 along its radially inner surface. An alternative sealing assembly 219 that can be used in place of any one or more sealing assembly 119 is schematically shown in FIG. 4. In that embodiment, each sealing assembly comprises an annular Teflon® bead or ring 219 sandwiched and compressed between the outer surface of each cutter element 18 and the cylindrical surface defining the corresponding receptacle 120.

Referring again to FIG. 3, as will be described in more detail below, to leach PCD tables 20, cutter elements 18 are retained in ring 118 with substrates 22 sealed within the corresponding receptacles 120 (e.g., through one of the seal assemblies 119, 219). A leaching acid 108 is poured into chamber 102 to a level below shoulder 113, and ring 118 (with cutter elements 18 retained therein) is disposed in can 112 and seated against shoulder 113, as shown in FIG. 3, such that the PCD tables 20 are exposed and suspended above acid 108. Thus, in this embodiment, cutter elements 18 do not directly contact the liquid bath of acid 108. Lid 115 is then secured to end 112*a* of can 112, thereby sealing inner chamber 102 from the outside environment. The temperature and the pressure of the inner chamber 102 are then increased to begin transitioning acid 108 from a liquid to a vapor that fills chamber 102. In general, the temperature and pressure within chamber 102 can be increased using any suitable technique or device known in the art. For example, in some embodiments, a pressurized fluid may be used to increase the pressure within chamber 102. As another example, in some embodiments, a heat generating component may be coupled to the outer surface of can 112 such that heat generated by the heat generating component may increase the temperature within chamber 102. In general, the desired temperature and pressure within chamber 102 will depend on a variety of factors including, without limitation, the vapor temperature and pressure of the specific type of leaching acid 108 being used. As a result, the specific temperature and the pressure in the inner chamber 102 while vapor leaching in accordance with embodiments described herein may vary greatly. For most leaching acids, the temperature of inner chamber 102 during the leaching process ranges from ambient to 750° C.; while the pressure of the inner chamber 102 during the leaching process ranges from atmospheric to 500 bars.

The vapors of acid 108 in chamber 102 come into contact with the PCD tables 20 of cutter elements 18 held within holder 118, but are restricted and/or prevented from accessing and contacting substrates 22 via the sealing assemblies 119 (or sealing assemblies 219). Without being limited by this or any particular theory, the physical and chemical properties of the vapors of acid 108 enable PCD tables 20 to be leached at an accelerated rate as compared to liquid acid leaching. Specifically, the reactive molecules of the acid vapors (e.g., vapors of acid 108) are taken up within the volume of the PCD table (e.g., table 20) through a process known as absorption, thereby allowing a larger percentage of the volume of the PCD table to come into contact with the reactive molecules which carry out the leaching process. Thus, the PCD table may be leached much more rapidly than through traditional methods, which rely on adhesion of acid molecules to the outer surface of the PCD table in a process known as adsorption. Additionally, the elevated temperature within chamber 102 offers the potential to accelerate the leaching process as compared to liquid acid leaching as it reduces surface tension and the density of the acidic vapor.

Figure 5:
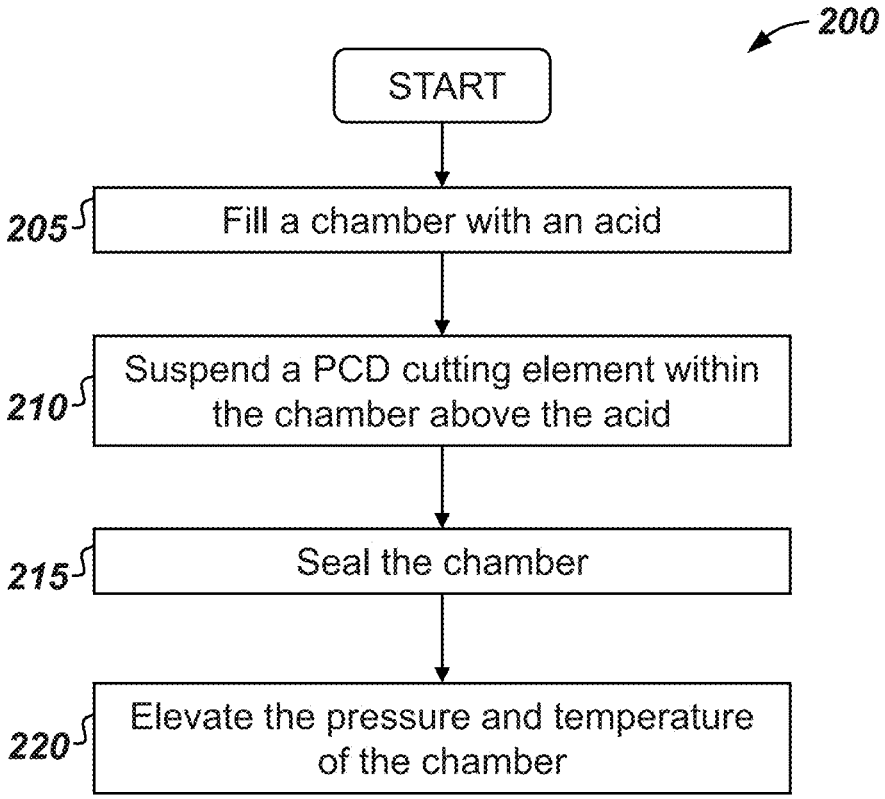
FIG. 5 is a schematic flow chart illustrating an embodiment of a method for leaching a PCD cutter element in accordance with the principles disclosed herein.

Referring now to FIG. 5, an embodiment of a method 200 for vapor leaching a PCD cutter element (e.g., cutter element 18) is shown. Method 200 will be described as being performed with system 100 previously described, however, it should be appreciated that method 200 can be performed with other suitable vessel(s) while still complying with the principles disclosed herein. Beginning in block 205, a liquid acid (e.g., acid 108) is disposed within a chamber (e.g., chamber 102). In general, the acid can be any suitable acid for leaching a PCD table (e.g., PCD table 20) including, without limitation, any of the leaching acids previously disclosed. Next, at block 210, one or more PCD cutter elements (e.g., cutter elements 18) are suspended within the chamber above the liquid acid such the cutter element(s) do not contact the liquid acid. The chamber is then sealed at block 215 (e.g., with lid 115), and the pressure and temperature within the chamber are elevated at block 220 such that the acid begins to vaporize and fill the chamber, thereby beginning the leaching of the PCD tables of the cutter element(s) (e.g., tables 20 of cutter elements 18). The substrate(s) of the cutter element(s) (e.g., substrates 22 of cutter elements 18) are protected from the leaching acid vapors by seals, coatings, or other suitable means. Vapor leaching according to method 200 offers the potential to reduce the total amount of time required to leach a given quantity of catalyst from the PCD table as compared with traditional acid bath leaching methods. For example, testing has indicated that vapor leaching PCD cutter elements in accordance with systems and methods disclosed herein can achieve a depth of leaching of 100 to 1000 microns from the outer surface of the PCD cutter element, whereas a similar result under conventional liquid leaching baths would require weeks.

In block 220 of method 200, the elevated pressure within the chamber can be maintained for a period of time, or cyclically pulsed during the vapor leaching process. Such pressure pulsing offers the potential to further enhance and accelerate the leaching process as it operates to force acid in and out of the pores of the PCD table in response to the cyclic pressure loading, thereby allowing fresh acid to be regularly circulated into the pores. Pressure pulsing may having a variety of amplitudes and cycle times while still complying with the principles disclosed herein. For example, the pressures may pulse from atmospheric pressure, to 500 bars, and then back to atmospheric pressure within a period of approximately two hours. Such pressure pulsing can be achieved in a number of ways, such as, for example, by altering the temperature of the environment within the chamber, or opening/closing a relief valve (e.g., relieve valve 106).

In the manner described, through use of vapor leaching process (e.g., method 200), leaching of PCD cutter elements (e.g., cutter elements 18) is performed at an accelerated rate when compared to conventional leaching practices. As a result, the time and costs required to manufacture a PCD cutter element are greatly reduced. In addition, such practices can also reduce the time and costs required to manufacture and/or refurbish fixed cutter drill bits (e.g., drill bit 10) that employ such PCD cutter elements.

Figure 6:
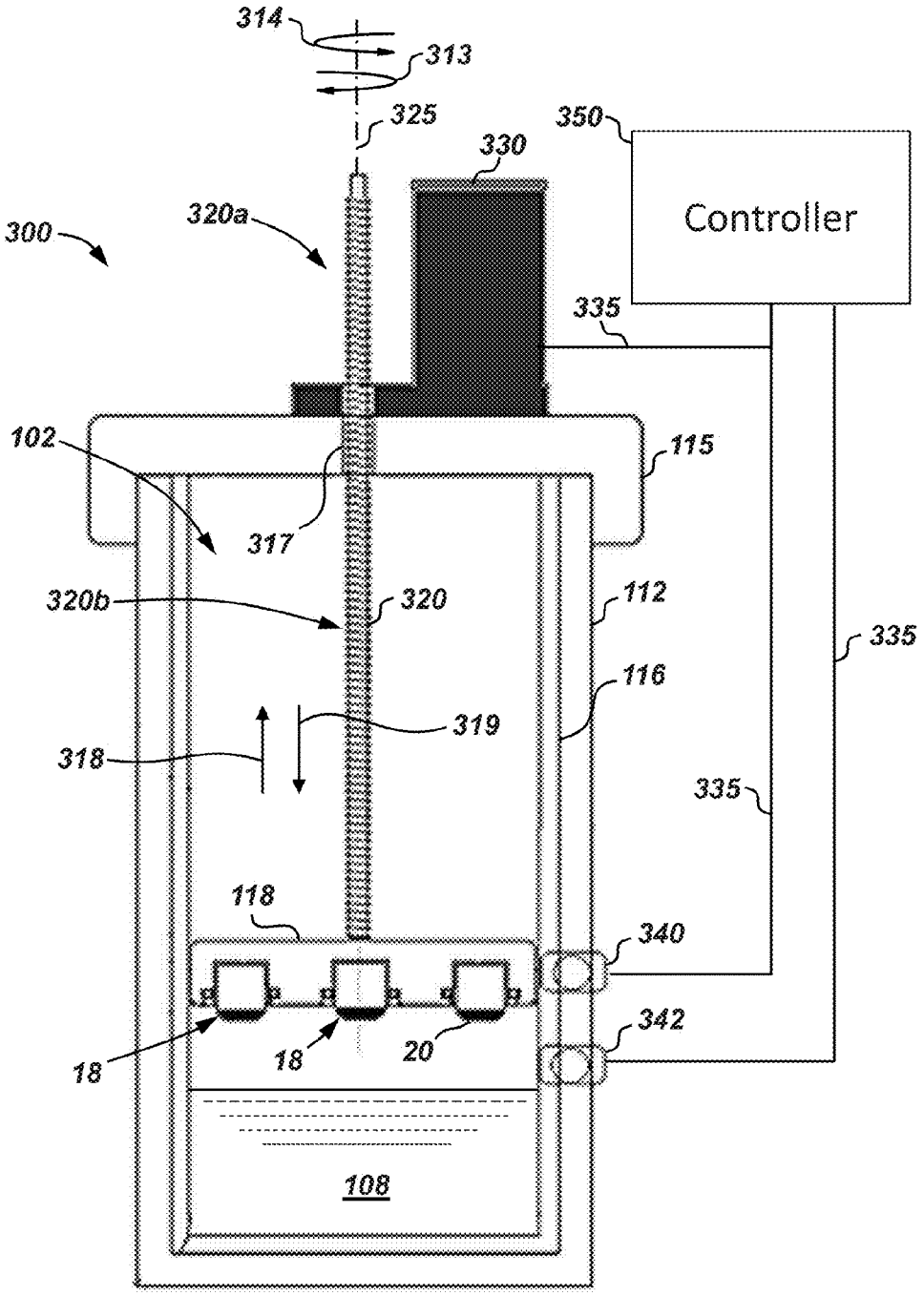
FIG. 6 is a schematic partial cross-sectional view of an embodiment of a system for vapor leaching PCD cutter elements in accordance with the principles disclosed herein.

While embodiments of vessel 100 disclosed herein have shown holder 118 to be disposed at a fixed position within chamber 102 during vapor leaching (i.e., holder 118 is seated against shoulder 113), it should be appreciated that in other embodiments, holder 118 is controllably moved up and down within the inner chamber 102 to dip PCD tables 20 into the liquid acid 108 in lower end 112*b* and then lift PCD tables 20 out of the liquid acid in lower end 112*b* (e.g., as shown in FIG. 6). In addition, in at least some of these embodiments, the cutter elements 18 are preferably cyclically dipped into the acid 108 over a set period of time in order to accelerate the overall leaching process. Further, in at least some of these embodiments, the pressure and temperature within the inner chamber during such mixed liquid-vapor leaching processes may be elevated to further accelerate the leaching of PCD tables 20. Still further, although holder 118 has been shown retaining three cutter elements 18 in FIG. 3, in general, the number and arrangement of cutter elements 18 supported within holder 118 can be varied while still complying with the principle disclosed herein. For example, in some embodiments, more or less than three cutter elements 18 may be supported within holder 118.

For example, referring now to FIG. 6, an embodiment of a system 300 for vapor leaching one or more cutter elements 18 is shown. System 300 is substantially the same as the system 100 previously described, except that lid 115 includes a throughbore or access port 317 extending therethrough, and lining 116 does not include the shoulder 113 (see FIG. 3). In addition, a threaded rod 320 having a set of external threads extends through port 317 along a central axis 325 thereby defining a first or upper portion 320*a* extending outside of inner chamber 102 and a second or lower portion 320*b* that extends within inner chamber 102. In this embodiment, throughbore 317 includes a set of internal threads (not shown) that threadably engage with the external threads disposed on rod 320 during operations. In addition, in some embodiments, a seal may be formed between rod 320 and lid 115 through any suitable method or device known in the art such that chamber 102 may still be effectively sealed off from the outer environment during operations. Lower portion 320*b* of rod 320 is rotatably coupled to support 118 such that rod 320 may rotate about the axis 325 relative to support 118 during operations (e.g., through suitable bearings). A motor or driver 330 is mounted on lid 115 outside of chamber 102 and is coupled to upper portion 320*a* of rod 320 such that actuation of motor 330 causes rod 317 to rotate about the axis 325. Thus, when rod 320 is driven to rotate about the axis 325 in a first direction 313 by motor 330, the rod 320 is inserted further within chamber 102 and holder 118 is lowered toward leaching bath 108 along direction 319. Conversely, when rod 320 is driven to rotate about the axis 325 in a second direction 314, which is opposite the first direction 313, by motor 330 the rod 320 is withdrawn from chamber 102 and holder 118 is raised away from leaching bath 108 along direction 318. In this embodiment, system further includes a pair of sensors 340, 342 that are arranged to sense the location of holder 118 within chamber 102 during operations. In this embodiment, sensors 340, 342 are optical sensors; however, any suitable sensor for detecting the position or presence of holder 118 within chamber 102 may be used while still complying with the principles disclosed herein. Each of the sensors 340, 342, and motor 330 are electrically coupled to a control unit or controller 350 through conductors 335; however, any suitable type of connection may be used such as, for example, a wireless connection. Controller 350 is configured to control the operation of motor 330 based on input signals received from sensors 340, 342 as well as internal programming disposed therein.

During a leaching operation, cutter elements 18 are mounted within holder 118 in the same manner as previously described above for system 100. Rod 320 is then installed within throughbore 317 and lid 115 is secured to end 112*a* of can 112, thereby sealing inner chamber 102 from the outside environment. The temperature and the pressure of the inner chamber 102 are then increased to begin transitioning acid 108 from a liquid to a vapor that fills chamber 102 in the manner previously described for the system 100. However, in addition, controller 350 additionally directs motor 330 to rotate rod 320 about axis 325 (e.g., about one of the directions 313, 314) to cyclically lower and raise the cutter elements 18 into and out of the acid bath 108. For example, in some embodiments, controller 350 initially actuates motor 330 to rotate rod 320 about axis 325 in the first direction 313 to lower holder 118 along the direction 319 until the sensor 342 detects the presence of holder 118 (which, in this embodiment corresponds to a position of holder 118 that allows the PCD tables 20 of the cutter elements 18 to be dipped or submerged within acid 108). A signal is then generated by sensor 342 which is routed to controller 350 which directs motor 330 to stop the rotation of rod 320 in direction 313. Thereafter, controller 350 directs motor 330 to rotate about the direction 314 raise the holder 118 along the direction 318 until the sensor 340 detects the presence of holder 118 (which, in this embodiment corresponds to a position of holder 118 that allows the PCD tables 20 of cutter elements 18 to be suspended above acid 108). A signal is then generated by sensor 340 which is routed to controller 350 which then directs motor 330 to stop rotation of rod 320 in the direction 314. In some embodiments, controller 350 may include a timer function that allows the upper most or lower most position of holder 118 (e.g., positions in which the holder 118 trips the sensors 340, 342, respectively) to be maintained for a preselected period of time.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simply subsequent reference to such steps.

What is claimed is:

1. A method for leaching a polycrystalline diamond (PCD) cutter element, the method comprising:

(a) suspending the PCD cutter element above a liquid acid bath in a chamber;

(b) elevating the temperature of the liquid acid bath above ambient conditions to transition at least some of the liquid acid bath to acid vapors;

(c) cyclically pulsing the pressure of the acid vapors in the chamber after (b);

(d) exposing the PCD cutter element to the acid vapors in the chamber while cyclically pulsing the pressure of the acid vapors during (c); and (e) leaching the PCD cutter element with the acid vapors in the chamber during (d).

2. The method claim 1, further comprising:

(f) lowering the PCD cutter element into the liquid acid bath; and (g) lifting the PCD cutter element out of the liquid acid bath after (f).

3. The method of claim 1, wherein (a) comprises:

(a1) inserting the PCD cutter element within a receptacle of a cutter element holder with a PCD table of the cutter element extending from the receptacle; and (a2) placing the cutter element holder and PCD cutter element within an inner chamber of a housing with the PCD table facing downward toward the liquid acid bath.

4. The method of claim 3, wherein (a2) further comprises supporting the cutter element holder within the inner chamber with an annular shoulder of the housing.

5. The method of claim 3, wherein (a) further comprises, restricting the flow of fluid between the receptacle and the PCD cutter element with a sealing assembly.

6. The method of claim 1, wherein (b) comprises elevating the temperature to a level between ambient conditions and 350° C.

7. The method of claim 1, wherein (c) comprises elevating the pressure to a level between atmospheric pressure and 500 bars.

8. The method of claim 1, wherein the liquid acid bath comprises at least one of nitric acid, sulfuric acid, hydrofluoric acid, and hydrochloric acid.

9. The method of claim 1, further comprising:

(f) lowering the PCD cutter element toward the liquid acid bath such that at least a portion of the PCD cutter element is exposed to the liquid acid; and (g) raising the PCD cutter element away from the liquid acid bath after (f) such that the PCD cutter element is suspended above the liquid acid bath.

10. The method of claim 1, wherein (c) further comprises:

(c1) increasing the pressure of the inner chamber from 500 bars to atmospheric pressure; and (c2) lowering the pressure of the inner chamber from 500 bars to atmospheric pressure.

11. The method of claim 10, wherein (c1) and (c2) take place over a period of approximately 2 hours.

* * * * *